US005398971A

United States Patent [19]

Ayele

[11] Patent Number: 5,398,971

[45] Date of Patent: Mar. 21, 1995

[54] FILE COVER RESTRAINING SYSTEM

[75] Inventor: Fikre Ayele, 1680 York Ave. #3G, New York, N.Y. 10128

[73] Assignee: Fikre Ayele, New York, N.Y.

[21] Appl. No.: 241,790

[22] Filed: May 12, 1994

[51] Int. Cl.[6] ..... B42D 1/00

[52] U.S. Cl. ..... 281/20; 281/29; 281/37; 402/80 R

[58] Field of Search ..... 281/15.1, 18, 20, 29, 281/37, 51; 402/70, 73, 80 R

[56] References Cited

U.S. PATENT DOCUMENTS

| | | | |
|---|---|---|---|
| 501,751 | 7/1893 | Waring . | |
| 717,842 | 1/1903 | Grimes . | |
| 1,021,832 | 4/1912 | Fletcher | 281/20 |
| 1,337,612 | 4/1920 | Miller | 281/20 |
| 2,323,285 | 6/1943 | Trussel . | |
| 4,524,991 | 6/1985 | Thomas | 281/20 |
| 4,531,764 | 7/1985 | Chang | 402/80 R |
| 4,569,613 | 11/1986 | Thomas | 402/80 R |
| 4,682,792 | 7/1987 | Simmons | 281/20 |
| 4,744,689 | 5/1988 | Sternberg | 402/502 X |
| 4,932,679 | 6/1990 | Mayer et al. | 281/18 |
| 4,997,207 | 3/1991 | Feldman | 402/502 X |
| 5,002,416 | 3/1991 | Serzen | 402/74 |
| 5,067,748 | 11/1991 | Wernquest | 402/73 X |
| 5,069,567 | 12/1991 | Fink et al. | 402/73 X |
| 5,267,804 | 12/1993 | Baumgarten | 402/80 R |

FOREIGN PATENT DOCUMENTS

| | | | |
|---|---|---|---|
| 2513942 | 4/1983 | France | 281/18 |
| 9002226 | 6/1983 | Germany | 402/502 |

*Primary Examiner*—Willmon Fridie
*Attorney, Agent, or Firm*—Robert W. J. Usher

[57] ABSTRACT

A binder cover restraining member comprises a central, one piece, restraining strut portion and cover mounting portions formed by inner and outer retention shoulders held spaced apart in opposed relation by a narrow neck portion, at respective opposite ends thereof. The cover members are formed with pairs of aligned keyhole mounting slots extending adjacent free edges thereof remote from the spine. Endmost retention shoulders can be pushed from inside the cover members through the wide slot portions and along the slots into the narrow retention portions so that inner and endmost retention shoulders engage respective opposite surfaces of the cover members retaining respective neck portions extending therethrough so that the strut extends between the inside surfaces of respect cover members to retain them in closed condition spaced apart in parallel relation.

4 Claims, 2 Drawing Sheets

FILE COVER RESTRAINING SYSTEM

FIELD OF THE INVENTION

The invention relates to a file cover restraining system for maintaining the cover members of a loose leaf binder spaced apart in parallel relation.

BACKGROUND OF THE INVENTION

The problems associated with maintaining the cover members of a loose leaf binder spaced apart in parallel relation are well recognized and there have been many prior attempts over many years to provide a satisfactory solution.

For example, U.S. Pat. No. 4,531,764 issued to Chang in 1985 teaches mounting an adjustable closed loop strip inside a cover to provide a spacer. However, the strip must be adjusted with any significant change in the number of papers in the file which procedure can be inconvenient and time consuming. Furthermore, the strip is intended to be permanently adhered to the cover preventing transfer and reuse on other files when the file is completely full and the spacer is not needed. In addition, the strip does not provide a closure member for the file.

In another approach, taught by U.S. Pat. No. 4,744,689, issued to Sternberg in 1988, a spacing block is mounted permanently along a free edge of one cover and hook and eye fasteners releasably secure the other cover to the top of the block. Again transfer from a completely full file to another would not seem to be possible, while a block mounting process would seem to involve an undesirably time consuming manufacturing process and the presence of block may add significantly to the weight of the binder.

Additionally, hook and loop fasteners can, in practice, be relatively difficult and time consuming to open.

In other approaches, taught by U.S. Pat. Nos. 4,569,613 and 4,524,991, issued to Thomas in 1984 and 1983, respectively, a channel section restraining member has clips releasably receiving the entire free edges of the covers along the open side remote from the spine. However, the restraining member must be completely removed from the file each time to open the file to add papers while it can be relatively difficult to align both the entire free edges with the respective clips for forcible receipt therein, particularly if the file is relatively worn and the hinged connection to the spine is weak so that the covers are not precisely aligned with each other or, if the file is slightly overfull, requiring the cover members to be manually forced together.

In an attempt to overcome at least some of the disadvantages of the above-mentioned teachings listed therein, U.S. Pat. No. 4,997,207 issued to Feldman in 1992 specifically directs that any such restraining member be permanently attached to a notebook cover, which is clearly disadvantageous as, when a binder is completely filled, the restraining member may no longer be needed and removal and mounting on the next unfilled or only partially filled binder is desirable.

In addition, the binder relies on a particular construction of detent latching mechanism which requires that the restraining member be depressed into the file along the entire length thereof to fasten and release the latching mechanism which can require difficult manipulation particularly as some papers may be improperly filed obstructing the inner movement of the restraining member or when the-file is slightly overfull. In addition, there would appear to be a risk of the hinge portion weakening in resiliency in use of the binder for an extended period.

In other approaches requiring permanent attachment of spacing members, U.S. Pat. No. 5,002,416 issued to Serzen in 1991, teaches post-form spacing portions which can be broken to required height and are preferably attached by adhesive to upstand from the inside surface of one cover member but do not secure the binder in closed condition; U.S. Pat. No. 501,751 issued to Waring in 1893 teaches loop-form restraining members located to upstand around the entire periphery of the file opening while U.S. Pat. No. 717,842 to Grimes teaches a height adjustable post screw mounted into a cover member requiring an undesirably massive construction, complex and expensive manufacture and relatively time consuming to assemble. The upstanding spacing or restraining members taught by Serzen and Grimes may also impede access to file papers during file use, while the ring catch taught by Grimes may prove relatively difficult to manipulate.

Still other approaches are described in U.S. Pat. No. 5,267,804 filed September 1991 and issued December 1993 to Baumgarten; U.S. Pat. No. 5,069,567 to Fink et al; French 252942 published 1983; German 9002226 published 1983; U.S. Pat. No. 5,067,748 issued 1991 to Wernques; U.S. Pat. No. 4,932,679 issued 1990 to Mayer.

U.S. Pat. No. 2,323,285 issued in 1943 to Trussel teaches the use of keyhole shaped slots in a spine mechanism for releasable retaining resiliently flexible binding rings or loops.

SUMMARY OF THE INVENTION

An object of the invention is to provide a file cover restraining system in which the cover members are maintained spaced apart in parallel relation, even when the file is only partly filled and yet which can easily be opened and closed.

Another object of the invention is to provide a file cover restraining system including a restraining member for maintaining the cover members spaced apart in parallel relation that can be releasably assembled with the file by coupling to respective cover members quickly and easily and that can be readily uncoupled to permit the file to be opened and closed and, additionally, which can be speedily completely disassembled from a file for mounting to another file when desired, both for economy of use of restraining members and to eliminate any unnecessary increase in shelf space being occupied by files not requiring restraining members as completely full.

A further object of the invention is to provide a file cover restraining system which occupies only a minimal amount of increased shelf space when the restraining member is assembled with the file.

An additional object of the invention is to provide a file cover restraining system which is economical to manufacture.

According to one aspect, the invention provides a file cover restraining system comprising a loose leaf binder of the type having a pair of substantially rigid cover members hingedly joined to respective opposite, parallel, longitudinal edges of a substantially rigid spine for receiving between them stacked papers and a restraining member for maintaining the cover members closed spaced apart in parallel relation comprising a central (one piece) restraining strut portion having cover mounting portions at respective opposite ends thereof each providing cover engaging retention shoulders spaced apart in opposed relation by a narrow neck portion, the cover members being formed with a pair of aligned mounting slots extending adjacent free edges thereof remote from the spine, and having wide entry portions for receiving respective endmost retention shoulders and which communicate in a direction longitudinally of the free edges with narrow retention portions so that the restraining member can be assembled with the file by insertion of respective outer retention shoulders from an inside surface of respective cover members axially through respective entry portions to the outer surface thereof and movement of the restraining members laterally along the respective retention slots into respective narrow portions so that inner and endmost retention shoulders engage respective opposite surfaces of the cover members retaining respective neck portions extending through respect narrow portions of the respective slots thereby to maintain the strut portion located extending between inside surfaces of respect cover members to retain them in closed condition spaced apart in parallel relation.

The retention slots occupy only a relatively small portion of the cover members which does not normally overlie the papers filed therein and therefore substantially no reduction in protection of the papers arises as a consequence of the slots.

Preferably, the retention portion of the mounting slot in one cover member is shorter than the retention portion of the mounting slot in another cover member and the entry portion of the mounting slot with the shorter retention portion is aligned opposite a part of the retention portion of the mounting slot in the said another cover member to permit release of a cover mounting portion only at one end of the restraining member from the front cover member to open the file.

Thus, the file can be opened by pushing only one cover mounting portion along the retention portion into and through the entry portion or mouth out from the slot and the mounting portion will still remain in the longer retention portion of the other cover member even if drawn up by the pushing action.

According to another aspect, the invention provides a file cover restraining system comprising a loose leaf binder of the type having a pair of substantially rigid cover members hingedly joined to respective opposite, parallel, longitudinal edges of a substantially rigid spine for receiving between them stacked papers and a one piece restraining member for maintaining the cover members in closed condition spaced apart in parallel relation comprising a central restraining strut portion having cover mounting portions at respective opposite ends thereof each comprising cover engaging retention shoulders in opposed relation, spaced apart by a narrow neck portion, the cover members being formed with a pair of aligned mounting slots extending adjacent and parallel respective free edges thereof remote from the spine so that, the outer retention shoulder members of the restraining member can, in a first position, be inserted from an inside surface of respective cover members axially through respective mounting slots to the outer surface thereof and moved with the neck portions extending through the respective slots to a second position in which the neck portions are retained extending through the respective slots by inner and endmost retention shoulders engaging with respective opposite surfaces of the cover members thereby to maintain the strut portion located extending between inside surfaces of respect cover members to retain them in closed condition spaced apart in parallel relation.

The restraining member is extremely compact, protruding only a minimal distance from the outer surfaces of respective cover members and is simple to manufacture as only a single piece of plastic and easily assembled with the file. The file can be opened by simple manipulation of only one end of the restraining member to withdraw the endmost retention shoulder thereof through the slot simply leaving the other end retained in the other cover member simplifying handling or file access.

Transfer between files as needed, for example, as soon as a file is completely filled with papers, is also easily effected minimizing the number of restraining members required reducing costs and shelf space as the restraining member may be only required for the most recently opened, endmost, partly filled file of a shelf of completely filled files.

BRIEF DESCRIPTION OF THE DRAWINGS

A specific embodiment of the invention will now be described by way of example only, with reference to accompanying drawings in which.

DESCRIPTION OF PARTICULAR EMBODIMENTS

Figure 3:
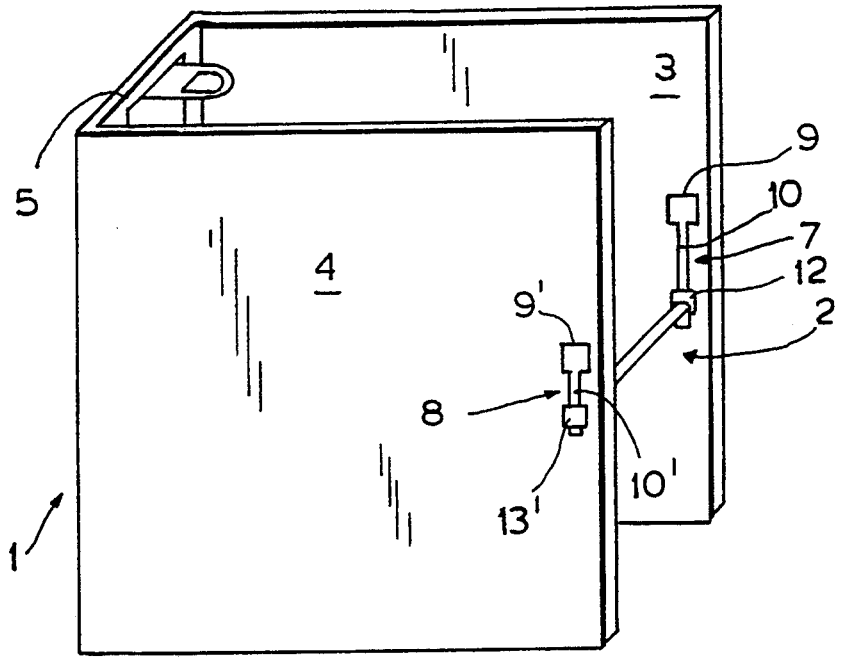
FIG. 3 is a perspective view of the file system during assembly of the restraining member on respective cover members of the loose leaf binder.
Figure 4:
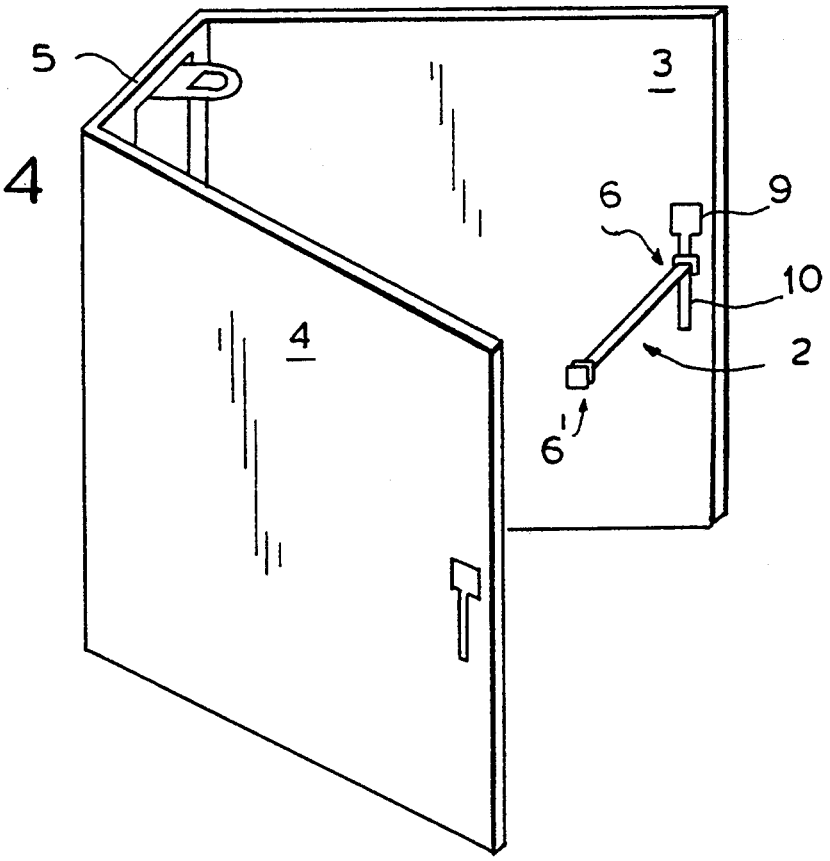
FIG. 4 is a perspective view of the file system with the restraining member mounted on respective cover members maintaining them in closed condition, spaced apart in parallel relation.

The file system comprises a loose leaf binder 1 and a restraining member 2. As shown in FIGS. 3 and 4, the binder 1 comprises first and second, rear and front, cover members 3 and 4, respectively, hingedly joined to respective opposite longitudinal edges of a substantially rigid, elongate spine 5. A conventional metal ring binding mechanism is mounted on the spine. First and second, keyhole shaped mounting slots 7 and 8 are formed in free edge portions of respective cover members with longitudinally axis extending adjacent and parallel to longitudinal free edges thereof. Each mounting slot 7 or 8, has an upper, relatively large, entry portion or mouth 9 or 9' communicating longitudinally with a lower, narrow retention portion 10 or 10'. The retention portion 10' of the mounting slot 8 in the front cover member 4 is shorter than the retention portion 10 of the mounting slot 7 in the rear cover member 7 and the entry portion or mouth 9' is at a lower level than the entry portion or mouth 9 for ease of assembly of the restraining member with the binder and release of only one end of the retaining member from the front cover member to open the file, as described further below.

Figure 1:
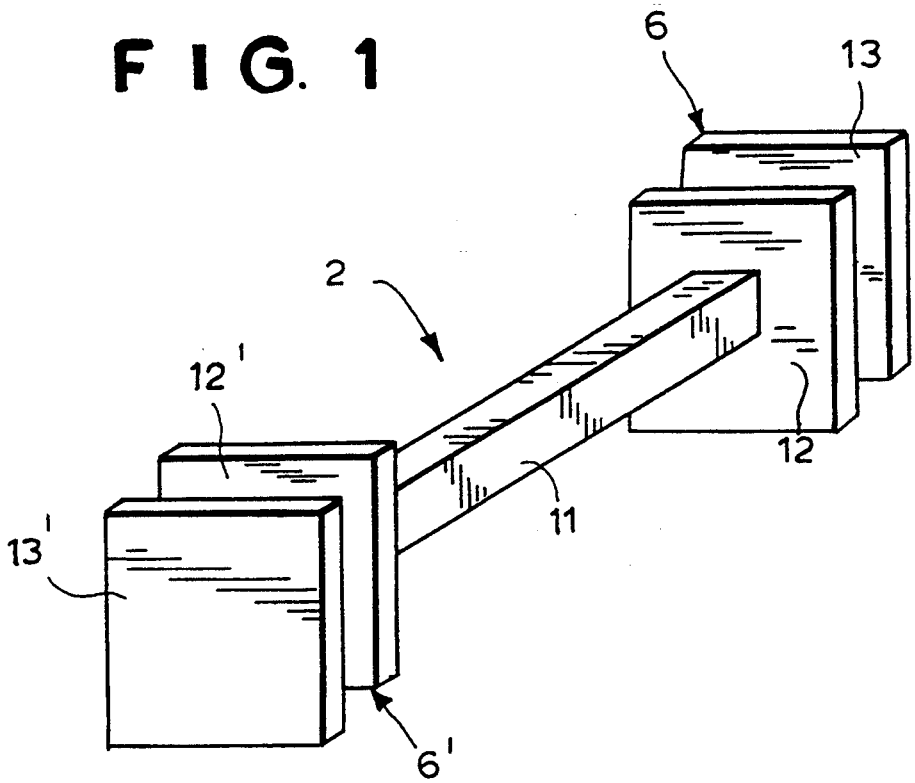
FIG. 1 is a perspective view of a restraining member of a file system according to the invention.
Figure 2:
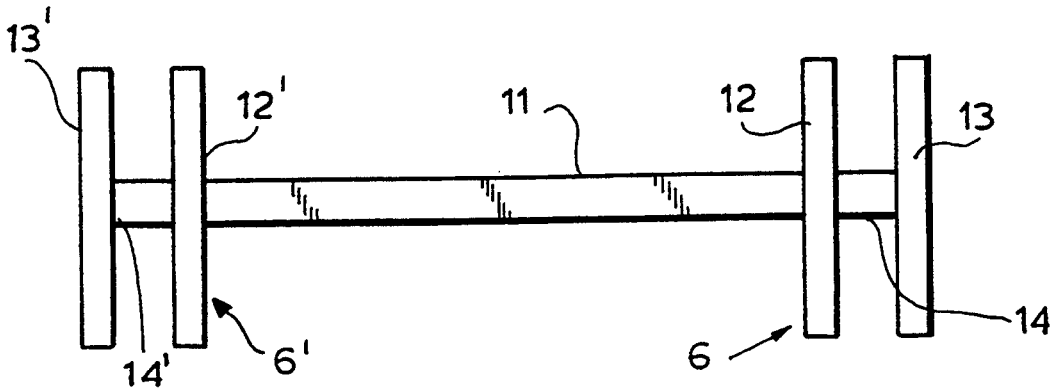
FIG. 2 is an elevational view of the restraining member.

As shown in FIGS. 1 and 2, the restraining member 2 is molded from a single piece of suitable plastic and comprises a central, rigid, elongate strut 11 with cover member mounting portions 6 and 6' comprising pairs of inner and outer, stiffly flexible flanges 12, 12' and 13, 13' forming retention shoulders at respective opposite ends thereof and maintained spaced apart in opposed parallel relation by narrow neck portions 14 and 14', respectively.

The restraining member can be assembled with the file by insertion of respective outer retention shoulders from inside surfaces of respective cover members axially through respective entry portions to the outer surface thereof and movement of the restraining member down the respective mounting slots into respective narrow retention portions so that the respective neck portions are held extending through the respective narrow retention portions by the engagement of inner and endmost retention shoulders with respective opposite surfaces of the cover members, thereby to maintain the strut portion extending between inside surfaces of respect cover members to retain them in closed condition spaced apart in parallel relation. Thus, during such assembly, the endmost flange 13 of mounting portion 6 is first inserted through entry portion or mouth 9 of mounting slot 7 in the rear cover member 3 and the restraining member moved down, into and part way along, the retention portion 10 to a location opposite the entry portion or mouth 9' of mounting slot 8 in the front cover member 4 securing the mounting portion 6 in the cover member 3. The endmost flange 13' of mounting portion 6' is then inserted through entry portion or mouth 9' of mounting slot 8 in the front cover member 3 and the restraining member moved down further so that respective neck portions 14 and 14' are retained extending through the respective retention portions 10 and 10' of mounting slots 7 and 8, respectively, adjacent bottom, blind thereof completely securing the restraining member to both front and rear cover members 3 and 4, respectively to maintain the cover members in closed condition, spaced apart in parallel relation.

As mentioned above, the file can be opened by moving the restraining member upward until retaining flange 13' is in registration with the entry portion 9' of the mounting slot 8 in the front cover member, and pushing or otherwise withdrawing flange 13' through the entry portion or mouth 9' releasing only the mounting portion 6' on one end of the retaining member from the slot 10' of the front cover member 4 with the mounting portion 6 on the other end of the restraining member also moved upwards and remaining in the longer retention portion 10 of the slot 7 in the rear cover member, at a location opposite the entry portion or mouth 9', as shown in FIG. 4.

In another embodiment, not shown, the retention flanges are circular and the retention slots are of gently curving shape to eliminate sharp corners subject to wear and risk of sharpness.

What is claimed is:

1. A file cover restraining system comprising a loose leaf binder of the type having a pair of substantially rigid cover members hingedly joined to respective opposite, parallel, longitudinal edges of a substantially rigid spine for receiving between them stacked papers and a restraining member for maintaining the cover members closed spaced apart in parallel relation comprising a central, one piece, restraining strut portion having cover mounting portions at respective opposite ends thereof each providing cover engaging retention shoulders spaced apart in opposed relation by a narrow neck portion, the cover members being formed with a pair of aligned mounting slots extending adjacent free edges thereof remote from the spine, and having wide entry portions for receiving respective endmost retention shoulders and which communicate in a direction longitudinally of the free edges with narrow retention portions so that the restraining member can be assembled with the file by insertion of respective outer retention shoulders from an inside surface of respective cover members axially through respective entry portions to the outer surface thereof and movement of the restraining members laterally along the respective retention slots into respective narrow portions so that inner and endmost retention shoulders engage respective opposite surfaces of the cover members retaining respective neck portions extending through respect narrow portions of the respective slots thereby to maintain the strut portion located extending between inside surfaces of respect cover members to retain them in closed condition, spaced apart in parallel relation.

2. A file cover restraining system according to claim 1 wherein the retention portion of the mounting slot in one cover member is shorter than the retention portion of the mounting slot in another cover member and the entry portion of the mounting slot with the shorter retention portion is aligned opposite a part of the retention portion of the mounting slot in the said another cover member to permit release of a cover mounting portion only at one end of the restraining member from the front cover member to open the file.

3. A file cover restraining system according to claim 1 wherein the entry portion of each mounting slot is above a respective retention portion.

4. A file cover restraining system comprising a loose leaf binder of the type having a pair of substantially rigid cover members hingedly joined to respective opposite, parallel, longitudinal edges of a substantially rigid spine for receiving between them stacked papers and a one piece restraining member for maintaining the cover members in closed condition spaced apart in parallel relation comprising a central restraining strut portion having cover mounting portions at respective opposite ends thereof each comprising cover engaging retention shoulders in opposed relation, spaced apart by a narrow neck portion, the cover members being formed with a pair of aligned mounting slots extending adjacent and parallel respective free edges thereof remote from the spine so that, the outer retention shoulder members of the restraining member can, in a first position, be inserted from an inside surface of respective cover members axially through respective mounting slots to the outer surface thereof and moved with the neck portions extending through the respective slots to a second position in which the neck portions are retained extending through the respective slots by inner and endmost retention shoulders engaging with respective opposite surfaces of the cover members thereby to maintain the strut portion located extending between inside surfaces of respect cover members to retain them in closed condition spaced apart in parallel relation.

* * * * *